United States Patent [19]

Mikulecky

[11] 3,972,015

[45] July 27, 1976

[54] HEAT INSULATED FUSED HIGH VOLTAGE BUSHING

[75] Inventor: Harvey W. Mikulecky, Racine, Wis.

[73] Assignee: RTE Corporation, Waukesha, Wis.

[22] Filed: Feb. 12, 1975

[21] Appl. No.: 549,388

Related U.S. Application Data

[63] Continuation of Ser. No. 385,436, Aug. 3, 1973, abandoned.

[52] U.S. Cl. ..... 337/202; 337/186; 337/276

[51] Int. Cl.[2] ..... H01H 85/02

[58] Field of Search ..... 174/142, 152 R; 337/186, 202, 276

[56] References Cited

UNITED STATES PATENTS

| | | | |
|---|---|---|---|
| 2,408,990 | 10/1946 | Mitchell | 174/142 |
| 2,537,348 | 1/1951 | Hubbard et al. | 337/202 X |
| 3,659,244 | 4/1972 | McKeithan | 337/202 |
| 3,663,928 | 5/1972 | Keto | 174/152 R |

*Primary Examiner*—Mark O. Budd
*Assistant Examiner*—Fred E. Bell
*Attorney, Agent, or Firm*—Ronald E. Barry

[57] ABSTRACT

A fused high voltage electrical bushing having a housing formed of a ceramic dielectric material, porcelain or glass, and having an axially extending passage, an electric terminal at each end of said passage, a fusible element within said passage interconnecting the terminals, a granular dielectric material completely filling the passage, a conductive layer of material on the inside surface of the passage, and a heat insulating sleeve positioned in the passage between the granular dielectric material and the inside surface of the housing to insulate the housing from the heat of the arc on interruption.

5 Claims, 1 Drawing Figure

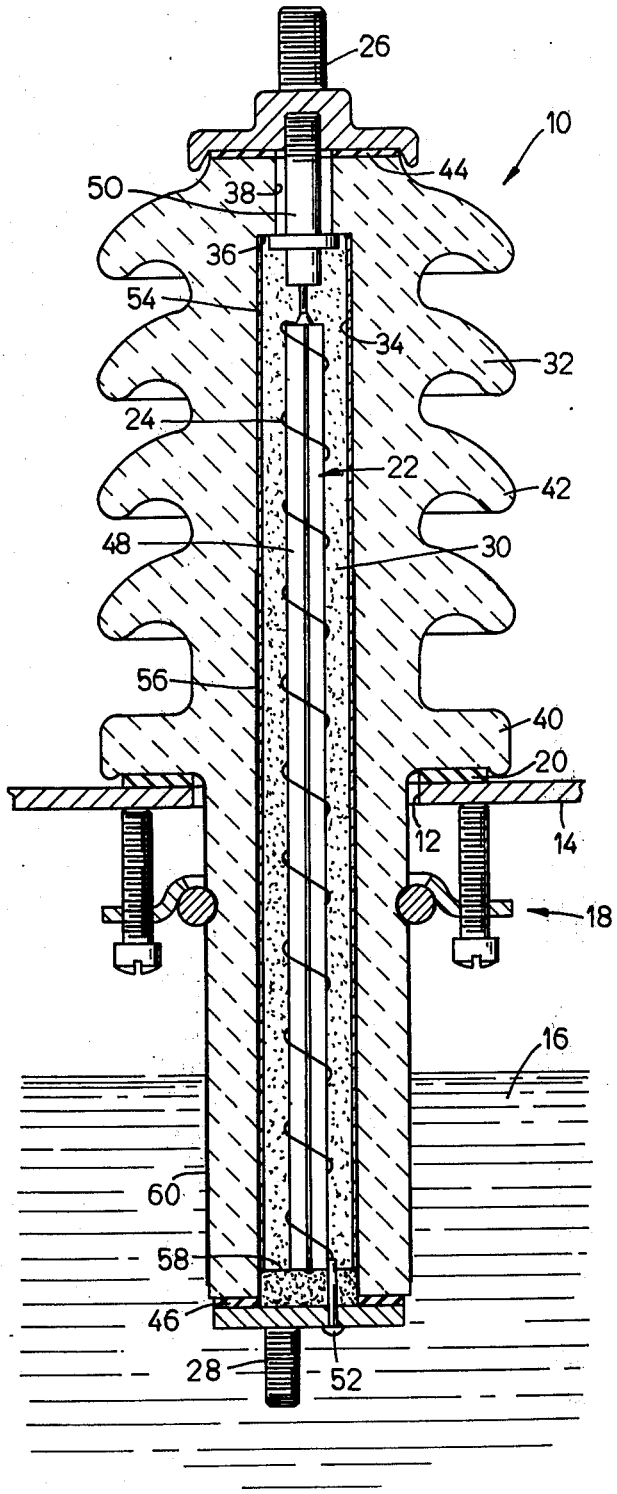
26
10
44
50
38
36
54
34
32
24
22
42
48
30
56
40
20
12
14
18
16
60
58
46
28
52

HEAT INSULATED FUSED HIGH VOLTAGE BUSHING

RELATED APPLICATION

This application is in continuation of my application Ser. No. 385,436, filed Aug. 3, 1973 now abandoned and entitled "A Heat Insulated Fused High Voltage Bushing".

BACKGROUND OF THE INVENTION

The fused bushing of the present invention is used to provide an electrical connection between a high voltage cable and an electrical device such as a transformer sealed within a casing. A bushing of the type contemplated herein is shown in copending application of Edward A. Link, Ser. No. 275,178, filed July 26, 1972 entitled "Combination Fuse and Bushing" and assigned to the same assignee. In this type of a bushing, a fuse assembly is provided within a central passage in the housing and is embedded in a granular dielectric material which acts to extinguish the arc upon interruption. The casing of the bushing is generally formed of a ceramic material such as porcelain or glass which under normal conditions can withstand the operating temperature of the fuse. However, upon the occurrence of a fault which causes fusing, the element temperature rises within the bushing substantially instantaneously rising to a melting temperature of 960°C. After element vaporization, the continuing arc can reach temperatures in excess of 1,000° C. The heat released is instantly absorbed by the adjacent granular material (commonly silica sand) producing a fulgurite, and then transferred through the surrounding material and housing over a short period of time. This can quickly raise the temperature of the inside surface of the housing to 300°–500°C. with the area closest to the fulgurite attaining maximum temperatures first. A differential temperature may occur between the inside and outside surface of the housing of 300°C. to 500°C. that can produce a thermal shock that will break the housing. In a high voltage environment in which the bushing is used, an extremely dangerous condition will occur if the bushing breaks since the high voltage lead will be exposed.

SUMMARY OF THE INVENTION

The fused bushing of the present invention overcomes the above problem by reducing the heat transfer rate and also producing a more uniform temperature rise on the housing surface. This is achieved by providing a heat insulating sleeve within the passage in the housing. The insulating sleeve will reduce the temperature on the surface of the passage and as a consequence, the rate of temperature rise between the inside surface of the passage and the outside wall surface of the bushing. The possibility of producing a thermal shock between the inside and outside surface of the bushing casing is thereby eliminated.

DRAWINGS

The drawing is a view in section of the fused high voltage electrical bushing shown mounted at the entrance to a casing for an electrical apparatus with the heat insulating sleeve positioned within the passage of the housing.

DESCRIPTION OF THE INVENTION

Referring to the drawing, the fused high voltage bushing 10 is shown mounted in an opening 12 in the casing 14 for an electrical device such as a transformer. The casing 14 is normally filled with a dielectric fluid or insulating oil 16 with the lower end of the bushing 10 extending into the oil 16. The bushing 10 is retained in the casing 14 by means of a mounting assembly 18 and is sealed in the opening 12 by means of a gasket 20. The mounting of the bushing 10 in the opening 12 of the casing 14 is generally well known.

The bushing 10 includes a fuse assembly 22 having a fusible element 24 generally in the form of a silver wire or ribbon, which is connected to electric terminals 26 and 28 provided at each end of the bushing 10. The fusible element 22 is embedded in a granular dielectric material 30 such as sand which acts to quench the arc produced on fusing of the element 24.

The bushing 10 includes a housing 32 having an axially extending passage 34 which terminates at one end at a shoulder 36 at the inner end of a reduced diameter opening 38. The housing 32 can be formed from any of a number of ceramic dielectric materials such as procelain or glass. These materials must be capable of withstanding the normal operating temperatures of a high voltage bushing. A mounting flange 40 is provided on the outer surface of the housing 32 intermediate the ends.

The bushing 10 is connected to a high voltage cable by means of the electric terminal 26 provided on the external end of the bushing. The terminal 26 is seated on and closes the opening 38 in housing 32. The terminal 26 is sealed by means of a gasket 44. The bushing 10 is connected to the electrical apparatus by means of electric terminal 28 provided at the inner end of the bushing. The terminal 28 is sealed thereon by means of a gasket 46.

The fusible element 22 includes a spider 48 which is supported in the passage 34 between the terminals 26 and 28. The silver wire 24 is wrapped around the spider 48 and is connected to the electric terminal 26 by means of a pin 50 and to the electric terminal 28 by means of a pin 52.

In accordance with the invention a heat insulating sleeve 54 is inserted within the passage 34 and has an outer diameter substantially equal to the inner diameter of the passage 34. The sleeve 54 is positioned between the granular dielectric material 30 and the inside surface of the housing 32 to insulate the housing 32 from the heat of the arc produced on fusing of the silver wire 24. The sleeve can be formed from any of the known heat insulating materials such as asbestos.

Under fault sensing conditions, the temperature of the fuse element will rise to its melting temperature at about 1,000°C. within a few seconds, depending on the fault magnitude. Following the fusing of the element, an arc at temperatures of 2,000–10,000°C. can exist for several milliseconds, releasing a sudden burst of heat in the element location. This heat is absorbed and stored in the fulgurite formation immediately surrounding the original element location. From there, it will transfer primarily by conduction means in all directions from the fulgurite, with the largest amount being outward to the fuse housing.

The element is spirally wound on the support spider which is generally star shaped. Thus, the element located on a rib lies closer to the housing wall than that portion between ribs. Therefore, the temperature of the wall closest to the element (and thus the fulgurite formed after fusing) will rise at a much faster rate than portions between turns and between ribs. This can cause additional thermal stresses.

Incorporation of a thermal insulating material greatly reduces the rate of heat flow to the housing wall and also permits the heat flow in other directions to raise the temperature of the granular material inside the fuse to a near uniform temperature before much heat is transferred through the thermal barrier. Therefore, the maximum temperature rise of the housing surface is greatly reduced and is of a nearly uniform distribution, reducing the thermal stress to acceptable levels.

The voltage stress at the point of entrance of the bushing 10 through the casing 14 can be reduced by providing a layer 56 of electrically conductive material on the inside surface of the passage 34 as described in the copending application Ser. No. 275,178. The material can be a conductive glaze or a conductive epoxy paint or any other conductive material which can be used for this purpose. The layer 56 extends through the opening 12 in the casing 14 and is connected to one or the other of the electric terminals 26 or 28 or to the silver wire 24 by means of a conductive member 58. The layer 56 is located between the inside surface of the passage and the outside surface of the insulating sleeve 54 so that it is protected from the thermal shock produced by the heat of the fuse under fault conditions.

Means can also be provided for reducing the voltage stress through the opening 12 in the form of an electrically conductive layer 60 provided on the outer surface of the housing 32. The layer 60 extends through the opening 12 a sufficient distance to be immersed in the dielectric fluid 16. The conductive layer 60 can be in the form of a conductive glaze, metallic paint or conductive epoxy. The upper end of the conductive layer 60 is grounded through casing 14 by means of the mounting assembly 18.

I claim:

1. A fused high voltage bushing for connecting a high voltage cable to an electrical device housed within a casing, said bushing comprising a housing formed of a ceramic dielectric material and having a passage, an electric terminal at each end of said passage, means for sealing said terminals to each end of said passage, a fusible element within said passage electrically connected to each of said terminals, a layer of conductive material on the inside surface of said passage, means for connecting said layer to one of said terminals, means within said passage for thermally insulating the surface of said passage from the heat generated on fusing of said element, and a granular dielectric material completely filling the space between said insulating means and said fusible element.

2. The bushing according to claim 1 including means for sealing said terminals to said housing.

3. The bushing according to claim 1 wherein said ceramic dielectric material is procelain.

4. A fused high volage bushing for connecting a high voltage cable to an electrical device through an opening within an electrically conductive casing, said bushing comprising a housing formed of a ceramic dielectric material mounted in said casing and extending through the opening in said casing, a layer of conductive material on the outer surface of said housing, said outer layer extending through said opening and being electrically connected to said casing, a passage in said housing extending through the opening in said casing, an electric terminal at each end of said passage, a layer of conductive material on the surface of said passage, said layer extending through said opening, means for connecting said conductive layer to one of said terminals, a fuse assembly within said passage and having a fusible element connected to each of said terminals, a sleeve formed from a heat insulating material positioned within said passage and having a length sufficient to insulate the full length of the housing from the heat of fusion of the fusible element, and a granular dielectric material completely filling the inside of said sleeve.

5. The bushing according to claim 4 including means for sealing said terminals to said housing.

* * * * *